US006871926B2

(12) United States Patent
Adkins et al.

(10) Patent No.: US 6,871,926 B2
(45) Date of Patent: Mar. 29, 2005

(54) METHOD OF ESTIMATING AN AMOUNT OF AVAILABLE INK CONTAINED IN AN INK RESERVOIR

(75) Inventors: Christopher A. Adkins, Lexington, KY (US); Michael C. Campbell, Lexington, KY (US); Donald F. Croley, Georgetown, KY (US); Mark W. Fagan, Lexington, KY (US); Brian T. Jones, Lexington, KY (US); Timothy L. Strunk, Lexington, KY (US); David E. Greer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/418,926

(22) Filed: Apr. 18, 2003

(65) Prior Publication Data

US 2004/0207668 A1 Oct. 21, 2004

(51) Int. Cl.[7] ..... B41J 29/393
(52) U.S. Cl. ..... 347/7; 347/19
(58) Field of Search ..... 347/7, 19

(56) References Cited

U.S. PATENT DOCUMENTS

| | | | | |
|---|---|---|---|---|
| 4,432,005 | A | | 2/1984 | Duffield et al. |
| 5,068,806 | A | | 11/1991 | Gatten |
| 5,414,452 | A | * | 5/1995 | Accatino et al. ..... 347/7 |
| 5,459,556 | A | | 10/1995 | Acquaviva et al. |
| 5,610,635 | A | * | 3/1997 | Murray et al. ..... 347/7 |
| 5,655,174 | A | | 8/1997 | Hirst |
| 5,721,573 | A | | 2/1998 | Benjamin |
| 5,758,224 | A | | 5/1998 | Binder et al. |
| 5,794,094 | A | | 8/1998 | Boockholdt et al. |
| 5,797,061 | A | | 8/1998 | Overall et al. |
| 5,802,420 | A | | 9/1998 | Garr et al. |
| 5,826,134 | A | | 10/1998 | Hino et al. |
| 5,937,225 | A | | 8/1999 | Samuels |
| 5,950,043 | A | | 9/1999 | Fujita et al. |
| 5,970,275 | A | | 10/1999 | Brown, Jr. et al. |
| 6,052,547 | A | | 4/2000 | Cuzzo et al. |
| 6,116,715 | A | | 9/2000 | Lefebvre et al. |
| 6,151,039 | A | | 11/2000 | Hmelar et al. |
| 6,196,651 | B1 | | 3/2001 | Zuber et al. |
| 6,360,174 | B1 | | 3/2002 | Shoki |
| 6,397,015 | B2 | | 5/2002 | Curry et al. |
| 6,431,673 | B1 | | 8/2002 | Heim et al. |
| 6,456,802 | B1 | | 9/2002 | Phillips |
| 6,476,837 | B2 | | 11/2002 | Ogata |
| 6,494,553 | B1 | | 12/2002 | Donahue et al. |
| 2002/0037173 | A1 | | 3/2002 | Kakeshita |
| 2002/0127024 | A1 | | 9/2002 | Matsumoto et al. |

* cited by examiner

*Primary Examiner*—Lamson Nguyen
*Assistant Examiner*—Blaise Mouttet
(74) *Attorney, Agent, or Firm*—Taylor & Aust, P.C.

(57) ABSTRACT

A method of estimating an amount of ink contained in an ink reservoir includes the steps of determining a cumulative actual ink drop count of ink drops expelled from the ink reservoir; and determining an evaporation amount associated with the ink reservoir, wherein before a time threshold the evaporation amount is ignored, and upon reaching the time threshold the evaporation amount is used to compensate for an evaporation loss for the ink reservoir by adjusting the cumulative actual ink drop count to form an evaporation compensated drop count.

16 Claims, 6 Drawing Sheets

METHOD OF ESTIMATING AN AMOUNT OF AVAILABLE INK CONTAINED IN AN INK RESERVOIR

BACKGROUND OF THE INVENTION

1. Field of the Invention

The present invention relates to an imaging apparatus, and, more particularly, to a method of estimating an amount of available ink contained in an ink reservoir.

2. Description of the Related Art

Ink jet disposable printhead cartridges include an ink reservoir that contains ink that is used to print on a print medium, such as paper. Typically, the ink level indicators on the printer in the Windows driver can keep track of the ink level based on counting the ink drops jetted on the print medium. In addition, the drops jetted during a printhead maintenance operation can be tracked as well. However, ink volume losses can occur in ways that cannot be tracked by only counting jetted ink dots. As used herein, the terms "ink dots" and "ink drops" are synonymous.

For example, it has been recognized that a significant loss of ink volume in a printhead cartridge can occur through evaporation. The evaporation occurs through the vent in the cartridge lid, through the nozzle openings in the printhead nozzle plate (even when capped), through the plastic cartridge body and through the cap seals. The loss rate depends, for example, on temperature and humidity, as well as the construction of the lid vent, cartridge material, etc.

What is needed in the art is a new method of estimating an amount of available ink contained in an ink reservoir that improves on prior methods that rely only on a counting of ink drops expelled from an ink reservoir, such as for example, by accounting for an estimated evaporation loss.

SUMMARY OF THE INVENTION

The present invention provides a new method of estimating an amount of available ink contained in an ink reservoir that improves on prior methods that rely only on a counting of ink drops expelled from an ink reservoir.

The invention comprises, in one form thereof, a method of estimating an amount of ink contained in an ink reservoir including the steps of determining a cumulative actual ink drop count of ink drops expelled from the ink reservoir; and determining an evaporation amount associated with the ink reservoir, wherein before a time threshold T1 the evaporation amount is ignored, and upon reaching the time threshold T1 the evaporation amount is used to compensate for an evaporation loss for the ink reservoir by adjusting the cumulative actual ink drop count to form an evaporation compensated drop count.

An advantage of the present invention is that it provides an estimate of an amount of available ink in an ink reservoir that is more precise than a method that relies only on a counting of ink drops expelled from an ink reservoir.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, in one form, and such exemplifications are not to be construed as limiting the scope of the invention in any manner.

DETAILED DESCRIPTION OF THE INVENTION

Figure 1:
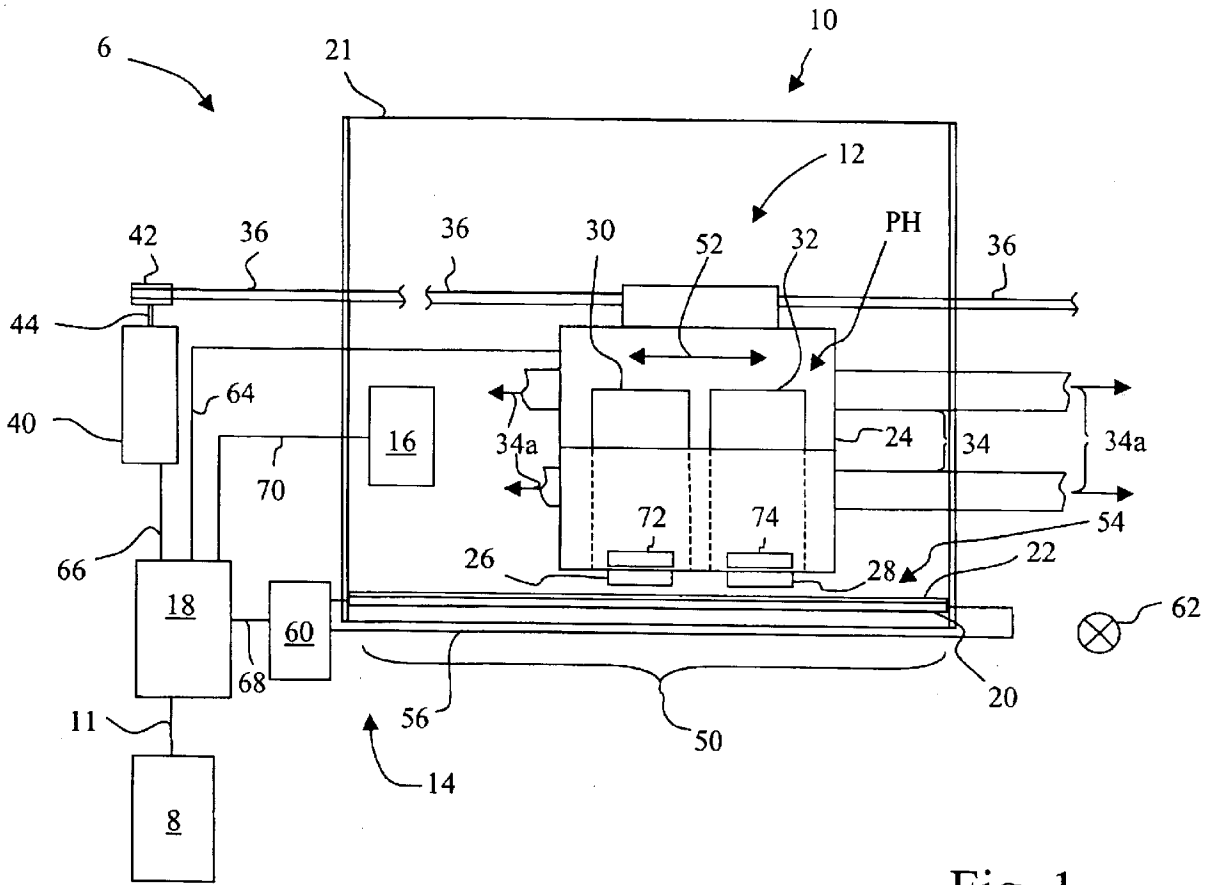
FIG. 1 is an imaging system embodying the present invention.

Referring now to the drawings, and particularly to FIG. 1, there is shown an imaging system 6 embodying the present invention. Imaging system 6 includes a host 8 and an imaging apparatus 10, in the form of an ink jet printer 10 as shown. Host 8 is communicatively coupled to imaging apparatus 10 via a communications link 11. Communications link 11 may be, for example, a direct electrical or optical connection, or a network connection.

Imaging apparatus 10 includes a printhead carrier system 12, a feed roller unit 14, a sheet picking unit 16, a controller 18, a mid-frame 20 and a media source 21.

Host 8 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, host 8 includes in its memory a software program including program instructions that function as an imaging driver for imaging apparatus 10. The imaging driver is in communication with controller 18 of imaging apparatus 10 via communications link 11. For example, where imaging apparatus 10 is an ink jet printer, the imaging driver serves as a printer driver that places print data and print commands in a format that can be recognized by ink jet printer 10. Communications between host 8 and imaging apparatus 10 may be facilitated via a standard communication protocol, such as the Network Printer Alliance Protocol (NPAP). The NPAP includes a multitude of predefined Network Printer Alliance (NPA) commands, and facilitates the generation of new NPA commands.

Media source 21 is configured to receive a plurality of print media sheets from which an individual print media sheet 22 is picked by sheet picking unit 16 and transported to feed roller unit 14, which in turn further transports print media sheet 22 during a printing operation. Print media sheet 22 can be, for example, plain paper, coated paper, photo paper and transparency media.

Printhead carrier system 12 includes a printhead carrier 24 for carrying a color printhead 26 and/or a monochrome printhead 28. A color ink reservoir 30 is provided in fluid communication with color printhead 26, and a monochrome ink reservoir 32 is provided in fluid communication with monochrome printhead 28. Those skilled in the art will recognize that color printhead 26 and color ink reservoir 30 may be formed as individual discrete units, or may be combined as an integral unitary printhead cartridge. Likewise, monochrome printhead 28 and monochrome ink reservoir 32 may be formed as individual discrete units, or may be combined as an integral unitary printhead cartridge.

Printhead carrier 24 is guided by a pair of guide rods 34. The axes 34*a* of guide rods 34 define a bi-directional scanning path for printhead carrier 24, and thus, for convenience the bi-directional scanning path will be referred to as bi-directional scanning path 34*a*. Printhead carrier 24 is connected to a carrier transport belt 36 that is driven by a carrier motor 40 via carrier pulley 42. Carrier motor 40 has a rotating carrier motor shaft 44 that is attached to carrier pulley 42. At the directive of controller 18, printhead carrier 24 is transported in a reciprocating manner along guide rods 34. Carrier motor 40 can be, for example, a direct current (DC) motor or a stepper motor.

The reciprocation of printhead carrier 24 transports ink jet printheads 26, 28 across the sheet of print media 22, such as paper, along bi-directional scanning path 34*a* to define a print zone 50 of imaging apparatus 10. The reciprocation of printhead carrier 24 occurs in a main scan direction 52 that is parallel with bi-directional scanning path 34*a*, and is also commonly referred to as the horizontal direction. During each scan of printhead carrier 24, the sheet of print media 22 is held stationary by feed roller unit 14.

Mid-frame 20 provides support for the sheet of print media 22 when the sheet of print media 22 is in print zone 50, and in part, defines a portion of a print media path 54 of ink jet printer 10.

Feed roller unit 14 includes an index roller 56 and corresponding index pinch rollers (not shown). Index roller 56 is driven by a drive unit 60. The index pinch rollers apply a biasing force to hold the sheet of print media 22 in contact with respective driven index roller 56. Drive unit 60 includes a drive source, such as a stepper motor, and an associated drive mechanism, such as a gear train or belt/pulley arrangement. Feed roller unit 14 feeds the sheet of print media 22 in a sheet feed direction 62, designated as an x in a circle to indicate that the sheet feed direction is out of the plane of FIG. 1 toward the reader.

Controller 18 includes a microprocessor having an associated random access memory (RAM) and read only memory (ROM). Controller 18 executes program instructions to effect the printing of an image on the sheet of print media 22, and executes further instructions to communicate with and monitor the operations of printheads 26, 28. Controller 18 is electrically connected and communicatively coupled to printheads 26, 28 via a communications link 64, such as for example a printhead interface cable. Controller 18 is electrically connected and communicatively coupled to carrier motor 40 via a communications link 66, such as for example an interface cable. Controller 18 is electrically connected and communicatively coupled to drive unit 60 via a communications link 68, such as for example an interface cable. Controller 18 is electrically connected and communicatively coupled to sheet picking unit 16 via a communications link 70, such as for example an interface cable.

Preferably, one of color printhead 26 and color ink reservoir 30 has attached thereto a memory 72 for storing information relating to color printhead 26 and/or color ink reservoir 30, such as for example, an identification number, a value representing an amount of usage of color printhead 26 and/or color ink reservoir 30, and one or more values representing time. In one embodiment, for example, memory 72 may be formed integral with other electrical components on the silicon of color printhead 26. Color printhead 26 may be configured to eject a single color of ink, or may be configured to eject multiple colors of ink, and two or more combinations of various colors of ink, e.g., black, cyan, magenta, yellow, diluted colors, orange, green and any other colors known in the art. Color ink reservoir 30 may be configured to carry a single color of ink, or may be configured to carry multiple colors of ink, and two or more combinations of various colors of ink, e.g., black, cyan, magenta, yellow diluted colors, orange, green and any other colors known in the art. Also, preferably, one of monochrome printhead 28 and monochrome ink reservoir 32 has attached thereto a memory 74 for storing information relating to monochrome printhead 28 and/or monochrome ink reservoir 32, such as for example, a supply item identification number, a value representing an amount of usage of monochrome printhead 28 and/or monochrome ink reservoir 32, and one or more values representing time. In one embodiment, for example, memory 74 may be formed integral with other electrical components on the silicon of monochrome printhead 28. Controller 18 communicates with memories 72, 74 via printhead interface cable 64.

Memory 72 associated with color printhead 26 and/or color ink reservoir 30 may include, for example, thirty-two or more bits reserved for an identification number for color printhead 26 and/or color ink reservoir 30, which may be set by the manufacturer or generated randomly upon installation in imaging apparatus 10; eight or more bits may be used as a usage gauge to maintain a record of usage of color printhead 26 and/or color ink reservoir 30, with each bit representing a level of depletion of ink from color ink reservoir 30; and four or more sets of time bits, represented for example as T0*c*, T1*c*, T2*c* and T3*c*, each including three or more time tracking bits, may be used to represent time. Time T0*c* may be, for example, an initial time of installation of color printhead 26 and/or color ink reservoir 30 in imaging apparatus 10; time T1*c* may be a time from initial time T0*c* to when an evaporation adjustment is to be made to an estimate of ink consumption; T2*c* may be an amount of time from time T1*c* to when the evaporation adjustment is finished, e.g., reaches zero; and time T3*c* may be may be the amount of time since color printhead 26 and/or color ink reservoir 30 was first installed in imaging apparatus 10. Ink usage information, as well as other information, may be separately maintained in memory 72 for each of the ink colors associated with color printhead 26 and/or color ink reservoir 30. By attaching memory 72 to color printhead 26 and/or color ink reservoir 30, in essence, information stored in memory 72 associated with color printhead 26 and/or color ink reservoir 30 can respectively travel with color printhead 26 and/or color ink reservoir 30 from one imaging apparatus to another.

Memory 74 of monochrome printhead 28 and/or monochrome ink reservoir 32 may include for example, thirty-two or more bits reserved for an identification number for monochrome printhead 28 and/or monochrome ink reservoir 32, which may be set by the manufacturer or generated randomly upon installation in imaging apparatus 10; eight or more bits may be used as a usage gauge to maintain a record of usage of monochrome printhead 28 and/or monochrome ink reservoir 32 with each bit representing a level of depletion of ink from monochrome ink reservoir 32; and four or more sets of time bits, represented by T0*m*, T1*m*, T2*m* and T3*m*, each including three or more time tracking bits, may be used to represent time. For example, time T0*m* may be an initial time of installation of monochrome printhead 28 and/or monochrome ink reservoir 32 in imaging apparatus 10; time T1*m* may be a time from initial time T0*m* to when an evaporation adjustment is to be made to an estimate of ink consumption; T2*m* may be an amount of time from time T1*m* to when the evaporation adjustment is finished, e.g., reaches zero; and time T3*m* may be may be the amount of time since monochrome printhead 28 and/or monochrome ink reservoir 32 was first installed in imaging apparatus 10. By attaching memory 74 to monochrome printhead 28 and/or monochrome ink reservoir 32, in essence, information stored in memory 74 associated with monochrome printhead 28 and/or monochrome ink reservoir 32 can travel respectively with monochrome printhead 28 and/or monochrome ink reservoir 32 from one imaging apparatus to another.

It is to be understood that the discussion that follows applies to either of color printhead 26 and/or color ink reservoir 30, or monochrome printhead 28 and/or monochrome ink reservoir 32, as discrete components or integrated into a unitary printhead cartridge. For convenience, however, sometimes the description of the invention that follows will be directed to monochrome printhead 28 and/or monochrome ink reservoir 32. Further, the previously identified time designations for the color implementation, i.e., T0*c*, T1*c*, T2*c*, T3*c*, and the previously identified time designations for the monochrome implementation, i.e., T0*m*, T1*m*, T2*m*, T3*m*, will simply be referred to using the time designations T0, T1, T2, and T3.

Figure 2:
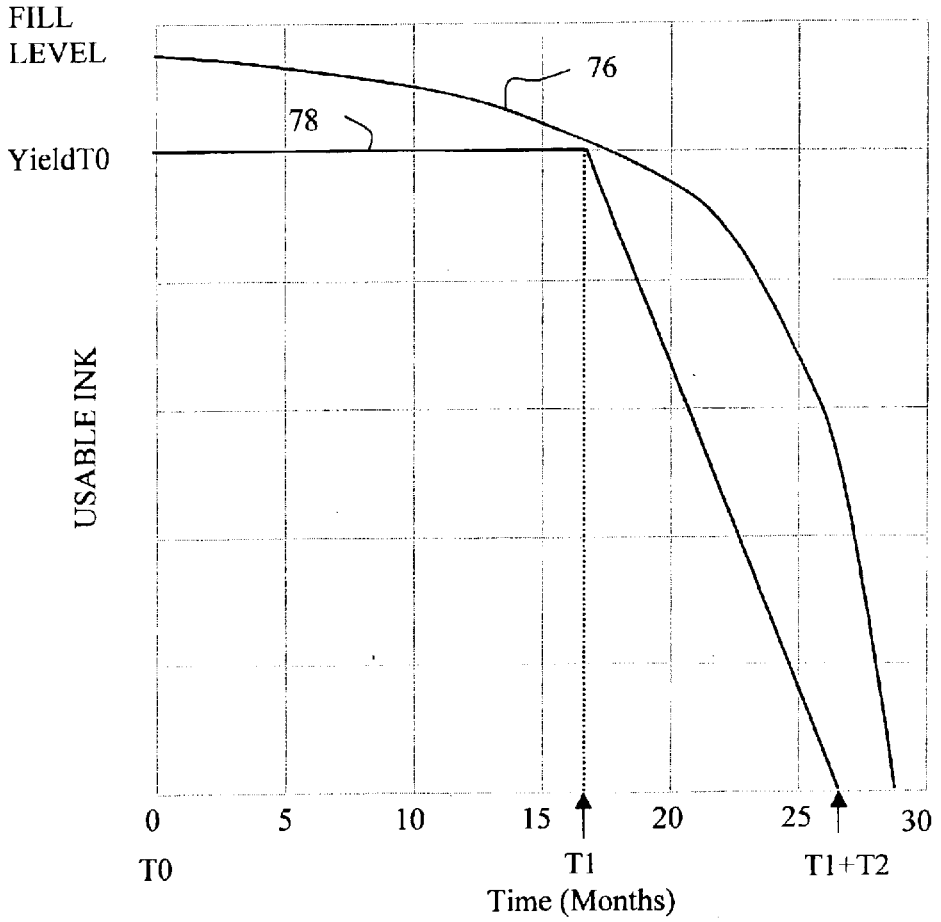
FIG. 2 depicts an ink evaporation yield curve and a linear approximation of the ink evaporation yield curve over time.

Referring to FIG. 2, the present invention utilizes a time based yield design based on the predictive curves of ink loss due to evaporation. Shown in FIG. 2 is an ink evaporation yield curve 76 associated with ink reservoir 32. Also shown is a linear ink evaporation curve 78, having a trapezoidal shape that is a linear approximation of ink evaporation yield curve 76 over time. As such, linear ink evaporation curve 78 may also be referred to as trapezoidal yield curve 78. Parameter YieldT0 designates the initial claimed yield of ink reservoir 32 at initial time T0, which represents the available, i.e., usable, ink in ink reservoir 32. The time parameter T1 specifies the accumulated time from installation of ink reservoir 32 when linear ink evaporation curve 78 begins. The time parameter T2 specifies the length of time measured from time T1 that it takes for linear ink evaporation curve 78 to go to zero. Thus, at time (T1+T2), the linear ink evaporation curve 78 will go to zero if no ink has been jetted from the ink reservoir 32 via printhead 28. Accordingly, if there is no ink jetted from the printhead 28, then it is desired that the ink level usage gauge bits of memory 74 should follow the trapezoidal yield curve, i.e., linear ink evaporation curve 78, as time increases.

As noted from FIG. 2, at time T0 the fill level of ink reservoir 32 is greater than the initial yield level YieldT0. The amount of fill level desired, accounting for the estimated evaporative ink loss, can be estimated by the equation:

$$\text{Fill Level}=\text{Yield}T0+(\text{evaporation rate}\times T1)$$

The evaporation rate may be determined based upon a linear approximation of the portion of the ink evaporation yield curve 76 between times T0 and T1. The time parameters T1 and T2 can be stored in memory 74 of printhead 28 and/or ink reservoir 32 to create trapezoidal yield curve 78. Times T1 and T2 may be selected based on the actual evaporation curve or evaporation rate for a given printhead cartridge, e.g., the integral combination of printhead 28 and ink reservoir 32, or for a given ink reservoir, e.g., ink reservoir 32. As an example, each of the times T1 and T2 may be represented in memory 74 by three binary bits, e.g., three fusible links, in memory 74, e.g., 12 months=100b, 6 months=011b, 4 months=010b, 2 months=001b, and zero months=000b.

In one embodiment, to calculate time, host 8 sends an NPA Ext Inkjet Cartridge Information command that contains the host's date and the identification (ID) of the host. The host date may be, for example, a 16-bit value defined as the number of days since Jan. 1, 2003. The NPA command can be sent prior to every print job, following an NPA Start Job command. Alternatively, host 8 could send the date and the host ID to imaging apparatus 10 in the print job start header information, rather than use an NPA command.

Firmware in controller 18 of imaging apparatus 10 uses the date in the current NPA command to calculate the difference in time (delta) since the last NPA command. The total accumulated time since printhead installation will be stored in the printhead in the time parameter T3, which is written by the firmware. Since only the total accumulated time before T1 needs to be tracked, the maximum time that needs to be stored as T3 is that equal to time T1. Thus, for example, if time T3 is represented by a six bit fusible link binary array in memory 74, then each bit of time T3 will represent T1/6. For example, if time T1=6 months, then each bit of time T3 will represent one month, or 30 days. Therefore, for example, when the total accumulated time increases by 30 days, another fuse in the T3 six bit fusible link binary array in memory 74 will be blown, or burned (i.e., taken to a binary level of 0).

Figure 3:
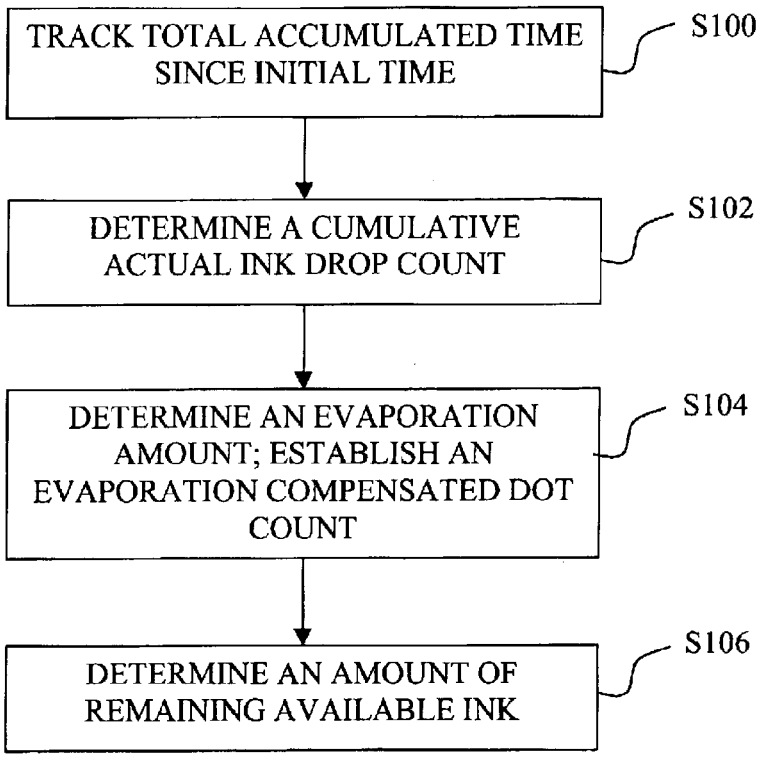
FIG. 3 is a general flowchart of a method of the present invention.

FIG. 3 is a general flowchart of a method of the present invention, which estimates an amount of ink contained in ink reservoir 32.

At step S100, time is tracked since the initial installation, or refilling, of ink reservoir 32 in imaging apparatus 10. This may be performed by controller 18 and/or host 8 by establishing an initial time T0 for ink reservoir 32, tracking a total accumulated time period Tt since the initial time T0, and comparing the total accumulated time period Tt to time threshold T1. Time Tt may be, for example, a compensated time based on time T3. In one embodiment, for example, time T1 is at least three months.

To obtain the total time the printhead associated with ink reservoir 32 has been in operation, several implementations are possible. One would be to add a T4 fuse register to memory 74 that represents time after T3 is empty (i.e., T1 has been reached). The use of time T4 would be similar to the use of T3 except the fixed time per fuse blown would be calculated by T2 divided by number of T4 bits. Another possibility would be to write the host date into memory 74 at the time of installation of printhead 28 and/or ink reservoir 32.

As an alternative, if a real time clock (RTC) were used, the install date burned into memory 74 would yield the total time since installation. For more robustness, two dates could be burned into memory 74: 1) the install date and 2) the date when ink reservoir 32 went empty. The subtraction of the two dates would document the length of time printhead 28 and/or ink reservoir 32 was in operation based on relative dates in case the RTC time is significantly different than world time.

At step 102, a cumulative actual ink drop count of ink drops expelled from ink reservoir 32 is determined. Each dot jetted from printhead 28 is counted by controller 18, or alternatively host 8, as ink used from ink reservoir 32. The ink usage may be tracked by blowing a fuse in the ink usage gauge array of memory 74 when the accumulated count counted by controller 18, or alternatively host 8, reaches the next usage gauge threshold boundary. For example, usage threshold boundaries may be established in the ink usage array of memory 74 to represent 1,000,000 dots each, and an additional usage fuse is blown as each threshold boundary is reached. Thus, the cumulative actual ink drop count of ink drops may be maintained in memory 74, or may be maintained in controller 18, or alternatively host 8, by retrieving ink usage information from memory 74.

At step 104, an evaporation amount associated with ink reservoir 32 is determined. As described above, the evaporation amount may be represented by linear ink evaporation curve (trapezoidal yield curve) 78. Referring to FIG. 2, before time threshold T1 is reached the evaporation amount is ignored. However, upon reaching time threshold T1, i.e., if the total accumulated time period Tt is equal to or greater than time threshold T1, then the evaporation amount is used to compensate for an evaporation loss for ink reservoir 32 by adjusting the cumulative actual ink drop count to form an evaporation compensated drop count. The evaporation amount may be represented as an equivalent ink drop count, wherein the evaporation compensated drop count is the sum of the cumulative actual ink drop count and the evaporation equivalent ink drop count.

For example, before time threshold T1 only the cumulative actual ink drop count of ink drops expelled from ink reservoir 32 is used in estimating a remaining amount of ink in ink reservoir 32. However, at or after time threshold T1 the evaporation compensated drop count is used in estimating a remaining amount of ink in ink reservoir 32. When the accumulated time since initial time T0 reaches T1 (i.e., all T3 fuses are blown), the firmware in imaging apparatus 10 will begin accumulating the evaporation amount of the evaporated ink at an evaporation rate defined by the equation:

$$\text{rate} = \frac{YieldT0}{T2}$$

The evaporation rate is used to calculate the amount of ink loss from ink reservoir 32 due to ink evaporation. The ink loss due to the evaporation amount is converted to an equivalent ink drop count, wherein the sum of the cumulative actual ink drop count is added to the equivalent ink drop count to form the evaporation compensated drop count. When the evaporation compensated drop count reaches the next usage threshold boundary, the next fuse in usage gauge in memory 74 associated with ink reservoir 32 will be blown.

As a more specific example, the evaporation amount may be calculated by the formula:

$$\text{EVP DOT COUNT}=(Tt-T1)*(\text{Yield}T0/T2)$$

wherein:

EVP DOT COUNT is the evaporation amount, in a dot count equivalent;

YieldT0 is the difference at initial time T0 between an initial amount of ink in ink reservoir 32 and a total amount of ink evaporation which is expected to occur by ink reservoir 32;

T1 is the time threshold with reference to initial time T0 at which the evaporation amount is used to compensate for the evaporation loss for ink reservoir 32;

T2 is the amount of time following time threshold T1 for ink evaporation in ink reservoir 32 to exhaust the amount of usable ink in the ink reservoir 32; and Tt is the total accumulated time since said initial time T0.

At step S106, by knowing the evaporation compensated drop count, i.e., the sum of the cumulative actual ink drop count and the evaporation equivalent ink drop count, as well as the initial drop count (estimated) at initial time T0, i.e., when ink reservoir 32 is full, then an amount of remaining ink available from ink reservoir 32 can be readily determined by subtracting the evaporation compensated drop count from the initial drop count.

Figure 4:
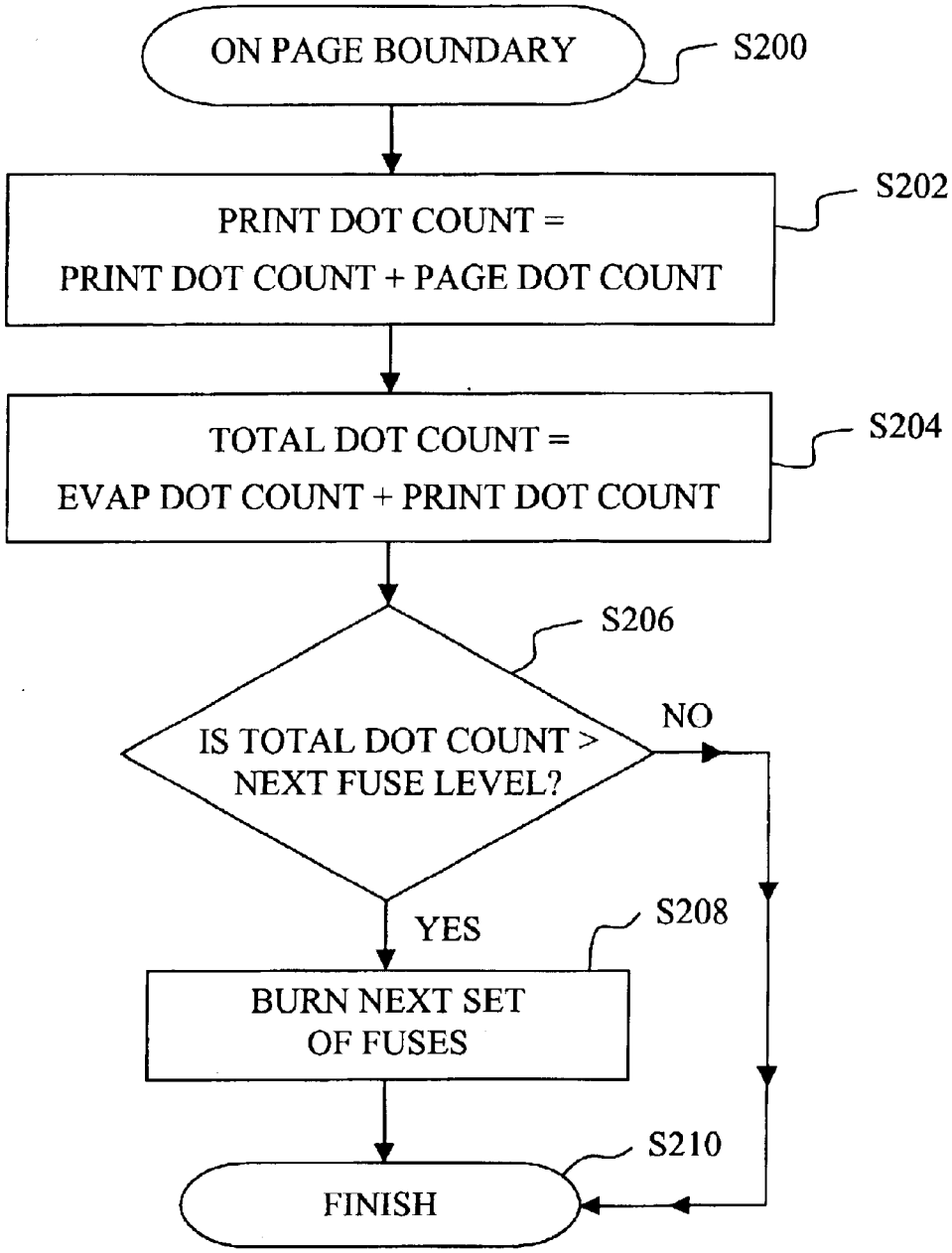
FIG. 4 is a flowchart of a routine for maintaining the evaporation compensated drop count.

FIG. 4 is a flowchart of a routine for maintaining the evaporation compensated drop count in memory 72 for each color, and in memory 74 for monochrome.

At step S200, it is indicated that the method for maintaining the evaporation compensated drop count is invoked at a convenient time, such as for example, at the beginning of a print job, or at a page boundary, i.e., between printed pages, during printing with imaging apparatus 10. For purposes of this embodiment the convenient time is selected to be the page boundary.

At step S202, controller 18, or alternatively host 8, updates the cumulative actual ink drop count (PRINT DOT COUNT) maintained in memory accessible to controller 18, or alternatively host 8, at the page boundary by the number of ink dots counted during the printing of the page. The cumulative actual ink drop count of ink drops may be maintained in the corresponding memory 72, 74, or may be maintained in controller 18, or alternatively host 8, by retrieving ink usage information from the usage gauge in corresponding memory 72, 74.

At step S204, the evaporation compensated drop count (TOTAL DOT COUNT) is formed as the sum of the cumulative actual ink drop count (PRINT DOT COUNT) and the evaporation amount equivalent ink drop count (EVAP DOT COUNT).

At step S206, it is determined whether the evaporation compensated drop count (TOTAL DOT COUNT) is greater than the next boundary fuse level, i.e., the next usage gauge threshold boundary. For example, usage threshold boundaries may be established in the ink usage array of memories 72, 74 to represent 1,000,000 dots each, and an additional usage fuse is blown as each threshold boundary is reached.

If the determination at step S206 is NO, then the method proceeds to finish, at step S210.

If the determination at step S206 is YES, then at step S208, the next usage level fuse is burned in the usage gauge memory 72 or 74, depending on whether the ink usage being monitored is color or monochrome, respectively. The method then proceeds to finish, at step S210.

Figure 5A:
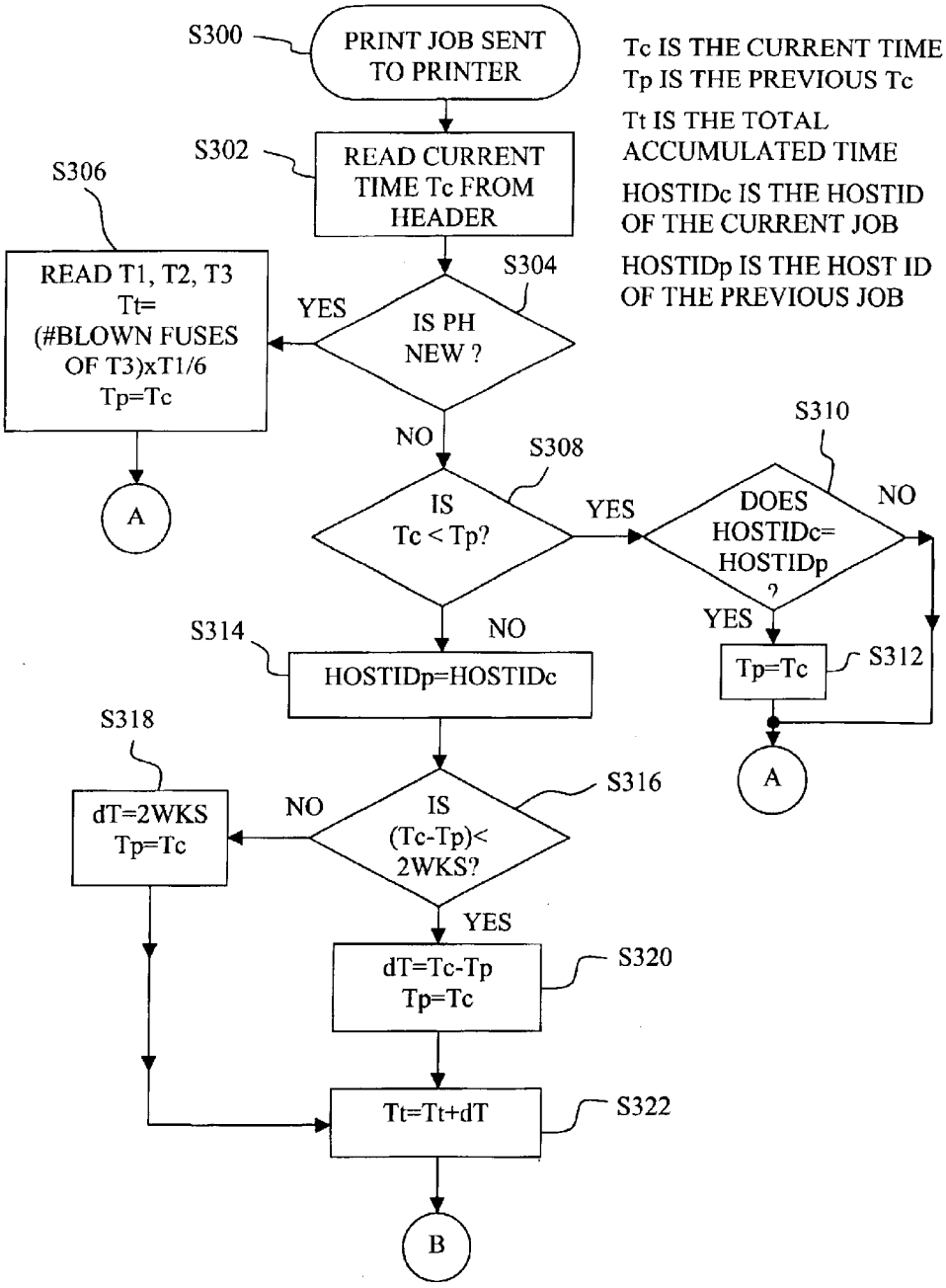
FIGS. 5A and 5B form a more detailed flow chart of a method of the invention.
Figure 5B:
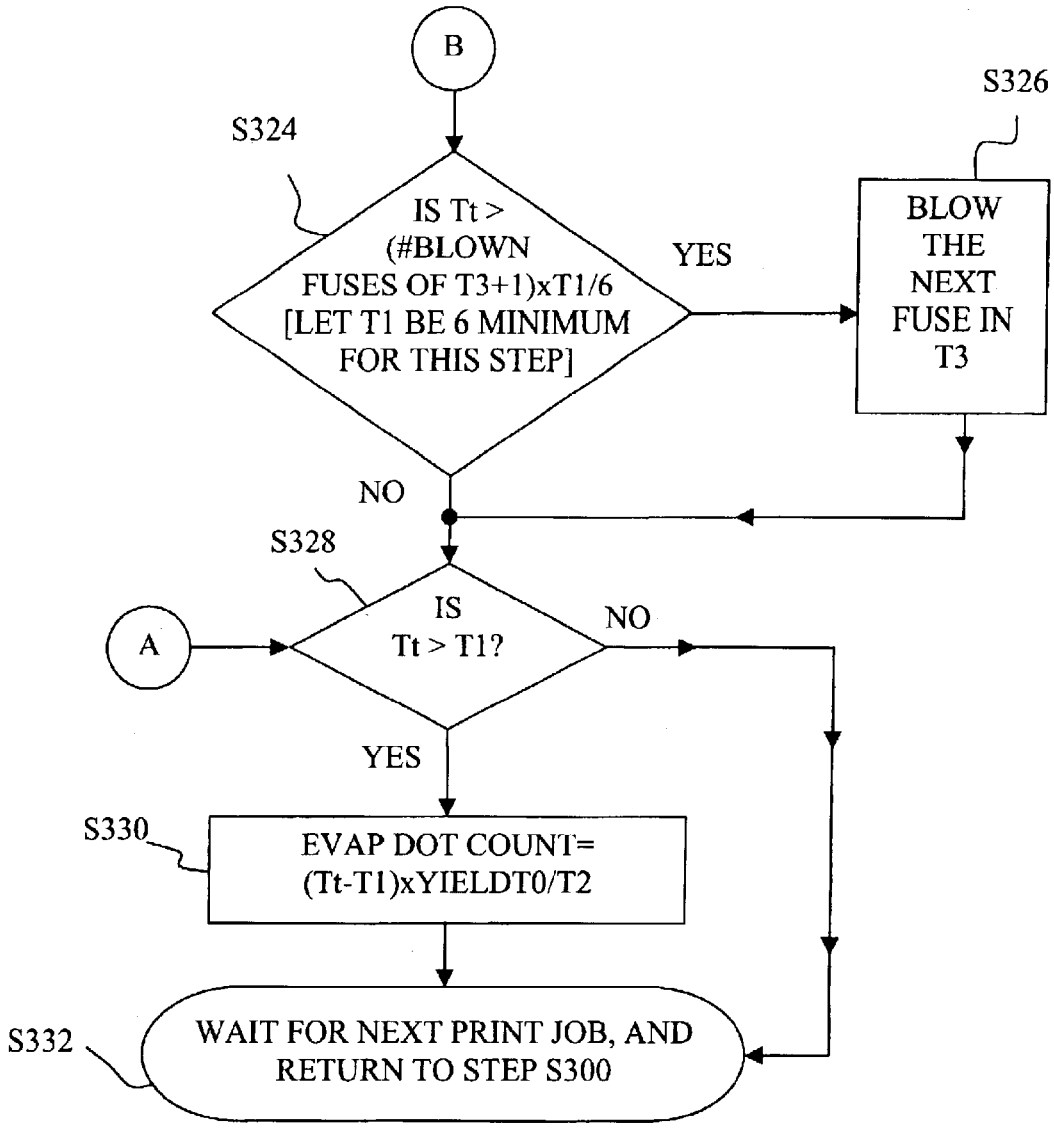

FIGS. 5A and 5B form a more detailed flow chart of a method of the invention. It should be noted that the firmware in controller 18 of ink jet printer 10 may keep a record of the last used printheads and/or ink reservoirs, such as each of particular types of printheads or ink reservoirs, e.g., mono, color or photo. Depending upon implementation details, each record may be maintained for the discrete components (printheads or ink reservoirs) or as respective integral unitary printhead cartridges. Each record will include the total dot counts, and the total accumulated time since installation. However, for ease of understanding the invention, the description that follows is directed to monochrome printhead 28 and ink reservoir 32 which are formed as an integral printhead cartridge PH. It is to be understood, however, that the description that follows can be used for color printhead 26 and/or color ink reservoir 30, which also may be formed as an integral unitary printhead cartridge.

In the flow chart of FIGS. 5A and 5B, the following abbreviations have been used for brevity:

Tc is the current time;

Tp is the previous current time Tc;

Tt is the total accumulated time;

dT is the difference between current time Tc and previous time Tp;

HOSTIDc is the host ID of the current print job; and

HOSTIDp is the host ID of the previous print job.

At step S300, a print job is sent to ink jet printer 10.

At step S302, controller 18 reads the current time Tc from the header of the print job.

At step S304, it is determined whether printhead cartridge PH is new. For example, if a printhead cartridge PH is installed with a blank printhead cartridge ID in memory, then the printer will recognize the printhead cartridge as a new printhead cartridge and will read the yield parameters from the printhead cartridge. The total dot count and the total accumulated time will be set to zero. If a printhead cartridge is installed with a non-blank printhead cartridge ID, but has not been recorded by the firmware of controller 18, then the firmware of controller 18 will use the total dot count stored in the ink usage gauge of the newly installed printhead cartridge PH. The remainder dot counts in controller 18 of ink jet printer 10 for the last printhead installed of that type will also be added to the total dot counts of the newly installed printhead cartridge. However, the total accumulated time will be set to the value in T3 of the printhead cartridge.

If the result at step S304 is YES, the initialization routine of step S306 is invoked.

At step S306, controller 18 reads time values T1, T2 and T3 from memory 74. Controller 18 then calculates the total accumulated time Tt using the formula: Tt=(the number of blown fuses of T3)×(T1/6). Previous time Tp is set equal to the current time Tc. The process then proceeds to step S328.

If at step S304 it is determined that the printhead cartridge PH is not new, e.g., the installed printhead cartridge PH is recognized by the firmware of controller 18, then the firmware of controller 18 will use the total dot count and the total accumulated time stored in the memory, such as NVRAM, of controller 18. If the current value in T3 is greater than the total accumulated time, then the total accumulated time will be updated. If the determination at step S304 is NO, then the process proceeds to step S308 to determine whether the time maintained by host 14 is correct.

As an alternative to step S308, ink jet printer 10 could use a battery operated real time clock (RTC) to keep track of time. Therefore, host 14 would not need to send any date information to ink jet printer 10. The install date for printhead cartridge PH can be stored in printhead cartridge memory 74 and the time threshold T1 can be determined by subtracting the current date from the install date and comparing the result to the T1 value.

Another alternative to using the RTC would be to store a date value into the memory of controller 18 (e.g., NVRAM) and blow fuses in the time T3 array in a similar manor as the host date design described above (i.e., blow a fuse after a fixed amount of time elapses). The advantage here in using the RTC is that the host date error handling would not be needed.

At step S308, it is determined whether the current time Tc is less than previous time Tp. When controller 18 of ink jet printer 10 records a time from the NPA command that is less than the previous time recorded, then controller 18 will reset the current time Tc only if the Host ID for the current job is the same as the Host ID for the previous job. Accordingly, if the determination at step S308 is YES, then the process proceeds to step S310.

At step S310, it is determined whether the host ID of the current print job HOSTIDc is equal to the host ID of the previous print job HOSTIDp.

As such, if the determination at step S310 is YES, then at step S312 current time Tc is set equal to previous time Tp. The process then proceeds to step S328.

If the determination at step S310 is NO, the process proceeds to step S328.

At step S308, if the determination is NO, the host time is acceptable, and at step S314 the host ID of the previous print job HOSTIDp is set equal to the host ID of the current print job HOSTIDc.

At step S316, it is determined whether the difference time dT between the current time Tc and the previous time Tp is less than two weeks. Step S316 serves a clamping function, so as to limit the evaporation amount used to a maximum time period, in this case, two weeks.

At step S316, if the determination is NO, then at step S318 time dT is set to 2 weeks, and previous time Tp is set equal to the current time Tc. In case the host computer's time becomes incorrect, the amount of evaporative loss must be clamped to avoid excessive/incorrect adjustment to the usage array. In the described embodiment, the maximum time difference, dT, may be for example, 14 days, although any reasonable amount of time given the evaporation rate could be used. Prior to T1 being reached the clamped adjustment of 14 days maximum would be preferred to avoid premature enabling of the evaporative loss dot count adder at step S330 (see FIG. 5B). For example, if the evaporation rate is equivalent, for example, to 50 pages/month and the time difference dT is actually 3 months, then dT is clamped to two weeks and the evaporation will be limited to 25 pages (i.e., 14 days worth). However, when using NPAP, the time in ink jet printer 10 is set based on the time read from the NPA command regardless of the time difference dT.

The process then proceeds to step S322.

At step S316, if the determination is YES, then at step S320 time dT is set to the difference between the current time Tc and the previous time Tp, and then previous time Tp is set equal to the current time Tc. The process then proceeds to step S322.

At step S322, total accumulated time Tt is updated by time dT, i.e., the new total accumulated time Tt is the sum of the previous total accumulated time Tt plus time differernce dT. The process then proceeds to step S324 of FIG. 5B.

At step S324, it is determined whether total accumulated time Tt is greater than the calculation (the number of blown fuses of T3+1)×(T1/6), wherein in this example the minimum T1 is six.

If the determination at step S324 is YES, then at step S326 the next fuse in the time T3 arrary in memory 74 is blown, i.e., burned to an open state. The process then proceeds to step S328.

If the determination at step S324 is NO, then the process proceeds to step S328.

At step S328 it is determined whether time total accumulated time Tt is greater than time T1.

If the determination at step S328 is NO, then the process proceeds to step S332, wherein the process waits for the next print job and returns to step S300.

If the determination at step S328 is YES, then the process proceeds to step S330, wherein the evaporation amount equivalent ink drop count (EVAP DOT COUNT) is determined by the equation:

$$\text{EVP DOT COUNT}=(Tt-T1)*(\text{Yield}T0/T2).$$

Thereafter, the evaporation compensated drop count can be formed as the sum of the cumulative actual ink drop count and the evaporation amount equivalent ink drop count EVP DOT COUNT. By knowing the initial drop count (estimated) at initial time T0, i.e., when printhead cartridge PH is new, then an amount of remaining ink available from printhead cartridge PH can be readily determined by subtracting the evaporation compensated drop count from the initial drop count.

Thereafter, the process proceeds to step S332, wherein the process waits for the next print job and returns to step S300.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of estimating an amount of ink contained in an ink reservoir, comprising the steps of:

determining a cumulative actual ink drop count of ink drops expelled from said ink reservoir; and determining an evaporation amount associated with said ink reservoir, wherein before a time threshold T1 said evaporation amount is ignored, and upon reaching said time threshold T1 said evaporation amount is used to compensate for an evaporation loss for said ink reservoir by adjusting said cumulative actual ink drop count to form an evaporation compensated drop count, wherein said time threshold T1 is at least three months.

2. The method of claim 1, further comprising the step of establishing an initial time T0 for said ink reservoir;

tracking a total accumulated time period Tt since said initial time T0; and comparing said total accumulated time period Tt to said time threshold T1, wherein if said total accumulated time period Tt is equal to or greater than said time threshold T1, then performing an adjusting of said cumulative actual ink drop count to form said evaporation compensated drop count.

3. The method of claim 1, wherein said ink reservoir is combined with a printhead to form a unitary printhead cartridge.

4. The method of claim 3, wherein said evaporation amount also is associated with said printhead.

5. The method of claim 1, further comprising the step of determining a remaining amount of available ink in said ink reservoir based on said evaporation compensated drop count.

6. A method of estimating an amount of ink contained in an ink reservoir, comprising the steps of:

determining a cumulative actual ink drop count of ink drops expelled from said ink reservoir; and determining an evaporation amount associated with said ink reservoir, wherein before a time threshold T1 said evaporation amount is ignored, and upon reaching said time threshold T1 said evaporation amount is used to compensate for an evaporation loss for said ink reservoir by adjusting said cumulative actual ink drop count to form an evaporation compensated drop count, wherein said evaporation amount is based on the formula: EA=(Tt−T1)*(YieldT0/T2)

wherein:

EA is said evaporation amount;

YieldT0 is a difference at an initial time T0 between an initial amount of ink in said ink reservoir and a total amount of ink evaporation which is expected to occur by said ink reservoir;

T1 is said time threshold, with reference to said initial time T0 at which said evaporation amount is used to compensate for an evaporation loss for said ink reservoir;

T2 is an amount of time following said time threshold T1 for an ink evaporation in said ink reservoir to exhaust an amount of usable ink in said ink reservoir; and Tt is a total accumulated time since said initial time T0.

7. A method of estimating an amount of ink contained in an ink reservoir, comprising the steps of:

establishing a time threshold T1 of at least three months;

determining a cumulative actual ink drop count of ink drops expelled from said ink reservoir; and determining an evaporation amount associated with said ink reservoir, wherein before said time threshold T1 said evaporation amount is ignored, and upon reaching said time threshold T1 said evaporation amount is used to compensate for an evaporation loss for said ink reservoir by adjusting said cumulative actual ink drop count to form an evaporation compensated drop count.

8. A method of estimating an amount of ink contained in an ink reservoir, comprising the steps of:

determining a cumulative actual ink drop count of ink drops expelled from said ink reservoir; and calculating an evaporation amount associated with said ink reservoir, wherein said evaporation amount is calculated by the formula: EA=(Tt−T1)*(YieldT0/T2)

wherein;

EA is said evaporation amount;

YieldT0 is a difference at an initial time T0 between an initial amount of ink in said ink reservoir and a total amount of ink evaporation which is excpected to occur by said ink reservoir;

T1 is said time threshold, with reference to said initial time T0 at which said evaporation amount is used to compensate for an evaporation loss for said ink reservoir;

T2 is an amount of time following said time threshold T1 for an ink evaporation in said ink reservoir to exhaust an amount of usable ink in said ink reservoir; and Tt is a total accumulated time since said initial time T0.

9. A method of estimating an amount of ink contained in an ink reservoir, comprising the steps of:

determining a cumulative actual ink drop count of ink drops expelled from said ink reservoir; and determining an evaporation amount associated with said ink reservoir, wherein before a time threshold T1 said evaporation amount is ignored, and upon reaching said time threshold T1 only an evaporation amount determined since T1 is used to compensate for evaporation loss for said ink reservoir by adjusting said cumulative actual ink drop count to form an evaporation compensated drop count.

10. The method of claim 9, wherein before said time threshold T1 only said cumulative actual ink drop count of ink drops expelled from said ink is used in estimating a remaining amount of ink in said ink reservoir.

11. The method of claim 9, wherein after said time threshold T1 said evaporation compensated drop count is used in estimating a remaining amount of ink in said ink reservoir.

12. The method of claim 9, wherein said evaporation amount is represented as an equivalent ink drop count, and wherein said evaporation compensated drop count is the sum of said cumulative actual ink drop count and said equivalent ink drop count.

13. The method of claim 9, further comprising the step of establishing an initial time T0 for said ink reservoir;

tracking a total accumulated time period Tt since said initial time T0; and comparing said total accumulated time period Tt to said time threshold T1, wherein if said total accumulated time period Tt is equal to or greater than said time threshold T1, then performing an adjusting of said cumulative actual ink drop count to form said evaporation compensated drop count.

14. The method of claim 9, wherein said ink reservoir is combined with a printhead to form a unitary printhead cartridge.

15. The method of claim 14, wherein said evaporation amount also is associated with said printhead.

16. The method of claim 9, further comprising the step of determining a remaining amount of available ink in said ink reservoir based on said evaporation compensated drop count.

* * * * *

UNITED STATES PATENT AND TRADEMARK OFFICE

CERTIFICATE OF CORRECTION

PATENT NO. : 6,871,926 B2
APPLICATION NO. : 10/418926
DATED : March 29, 2006
INVENTOR(S) : Christopher A. Adkins et al.

It is certified that error appears in the above-identified patent and that said Letters Patent is hereby corrected as shown below:

Column 12, line 35 (claim 8) “excpected” should be replaced with --expected--.

Signed and Sealed this

Twentieth Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 6,871,926 B2
APPLICATION NO. : 10/418926
DATED : March 29, 2005
INVENTOR(S) : Christopher A. Adkins et al.

It is certified that error appears in the above-identified patent and that said Letters Patent is hereby corrected as shown below:

Column 12, line 35 (claim 8) “excpected” should be replaced with --expected--.

This certificate supersedes Certificate of Correction issued March 20, 2007.

Signed and Sealed this

Tenth Day of April, 2007

JON W. DUDAS
*Director of the United States Patent and Trademark Office*